US005903928A

United States Patent [19]

Hyung-Seob

[11] Patent Number: 5,903,928

[45] Date of Patent: May 18, 1999

[54] DEVICE FOR HANGING SPECTACLES ON GARMENT

[75] Inventor: Kim Hyung-Seob, Kyungki-Do, Rep. of Korea

[73] Assignee: Pyung An Textile Co., Ltd., Seoul, Rep. of Korea

[21] Appl. No.: 09/093,067

[22] Filed: Jun. 8, 1998

[30] Foreign Application Priority Data

Aug. 23, 1997 [KR] Rep. of Korea ..... 97-22909

[51] Int. Cl.[6] ..... A41B 1/00

[52] U.S. Cl. ..... 2/244; 2/115; 2/69

[58] Field of Search ..... 2/115, 108, 77, 2/102, 106, 113, 271, 244, 94, 239, 85, 93, 69

[56] References Cited

U.S. PATENT DOCUMENTS

| | | | |
|---|---|---|---|
| 2,011,325 | 8/1935 | Rowan | 2/115 |
| 2,163,606 | 6/1939 | Kennedy et al. | 2/115 |
| 2,609,541 | 9/1952 | Kaplan | 2/115 |
| 2,624,050 | 1/1953 | Boller | 2/115 |
| 2,750,595 | 6/1956 | Hollinger | 2/113 |
| 4,637,075 | 1/1987 | Ingrisano et al. | 2/247 X |
| 4,885,805 | 12/1989 | Mason | 2/244 |
| 4,896,377 | 1/1990 | Ferdi | 2/115 |
| 4,917,651 | 4/1990 | Rainville | 2/271 X |
| 5,584,074 | 12/1996 | Battle-Smith | 2/115 |

*Primary Examiner*—Gloria Hale
*Attorney, Agent, or Firm*—Harrison & Egbert

[57] ABSTRACT

A device for hanging a pair of spectacles on a garment is disclosed. The device has a specifically designed hanging means, which is formed on a garment and is used for allowing a user to easily, conveniently and safely hang spectacles on the garment when taking off the spectacles. The spectacle hanging means is formed at one or more of the neck, breast, pocket, and button-down openings of a garment and selectively holds an arm of the spectacles so as to hang the spectacles on the garment. The hanging device thus allows a user to easily and safely keep spectacles on the garment when taking off the spectacles.

4 Claims, 23 Drawing Sheets

DEVICE FOR HANGING SPECTACLES ON GARMENT

BACKGROUND OF THE INVENTION

1. Field of the Invention

The present invention relates, in general, to spectacle hanging devices and, more particularly, to a device for hanging a pair of spectacles on a garment, the device having a specifically designed means for allowing a person to easily, conveniently and safely hang spectacles on a garment when not wearing the spectacles.

2. Description of the Prior Art

Typically, a variety of spectacles or eyeglasses have been widely and conveniently used. For example, the spectacles may be worn to aid vision or protect the eyes from external stimulation. Particularly, sunglasses are used for protecting the eyes from the sun. In such spectacles, the lenses are made of glass or synthetic resin, so the lenses are fragile and force users to carefully handle the spectacles. Spectacles typically designed for being stably worn on the nose and being stably hung over the ears. Therefore, the spectacles are generally not subject to careless breakage when they are worn. However, when the spectacles are removed, a user has to safely keep the spectacles in a case in order to protect the spectacles from external impacts or foreign substances, such as rain or dirt. However, it is inconvenient for a user to repeatedly put the spectacles into and take out of such a case. The spectacles also force a user to always carry a case when he is out and about.

In the prior art, some users preferably hang their spectacles 20 on the pockets 5 or the button-down openings 4 of their shirts 1 as shown in FIGS. 9*a* and 9*b* when they take off the spectacles 20. In such a case, an arm 21 of the spectacles 20 is hung on a pocket 5 or the stitched lower junction of buttoned and buttonholed parts of the opening 4 of a shirt, so the spectacles 20 are carried by the user while being hung on the shirt 1. The spectacles 20, hung on the pocket 5 or the button-down opening 4 of the shirt 1 as described above, also allow the user to maintain an appealing appearance and show one's fashion personality.

As well known to those skilled in the art, typical garments, such as shirts and blouses, are designed for giving users a good fit and allowing the users to carry one's necessities, such as handkerchiefs and purses. However, such garments are free from any specified means for safely hanging spectacles, so the spectacles, hung on the pocket or the button-down opening of a garment as described above, may be unexpectedly or carelessly impacted or easily removed from the garment, thus sometimes breaking or being lost. This forces user to purchase new spectacles.

SUMMARY OF THE INVENTION

Accordingly, the present invention has been made keeping in mind the above problems occurring in the prior art, and an object of the present invention is to provide a device for hanging a pair of spectacles on a garment, which is provided with a specifically designed means for allowing a user to easily, conveniently and safely hang the spectacles on the garment when taking off the spectacles, thus effectively preventing the spectacles from unexpectedly breaking or being lost.

In order to accomplish the above object, the present invention provides a device for hanging spectacles on a garment. The device comprises spectacle hanging means formed at one or more of the neck, breast, pocket, and button-down opening of the garment and adapted for selectively holding an arm of the spectacles so as to hang the spectacles on the garment.

BRIEF DESCRIPTION OF THE DRAWINGS

The above and other objects, features and other advantages of the present invention will be more clearly understood from the following detailed description taken in conjunction with the accompanying drawings, in which:

FIGS. 1*a* to 1*c* are views of a shirt provided with spectacle hanging slits at the button-down front opening in accordance with the primary embodiment of the present invention, in which:

FIG. 1*a* is a front view of the shirt;

FIG. 1*b* is a perspective view separately showing a pair of spectacles and the shirt; and FIG. 1*c* is a front view of the shirt with the spectacles being hung on the hanging slits;

FIGS. 2*a* to 2*c* are views of a shirt provided with a spectacle hanging fob at the pocket in accordance with the second embodiment of the present invention, in which:

FIG. 2*a* is a front view of the shirt;

FIG. 2*b* is a perspective view separately showing a pair of spectacles and the shirt; and FIG. 2*c* is a front view of the shirt with the spectacles being hung on the fob;

FIGS. 3*a* to 3*c* are views of a shirt provided with a spectacle hanging loop at each of the button-down front opening and the pocket in accordance with the third embodiment of the present invention, in which:

FIG. 3*a* is a front view of the shirt;

FIG. 3*b* is a perspective view separately showing a pair of spectacles and the shirt; and FIG. 3*c* is a front view of the shirt with the spectacles being hung on one of the hanging loops;

FIGS. 4*a* to 4*c* are views of a shirt provided with a spectacle hanging band and loop at the front bottom of the round neck and the pocket in accordance with the fourth embodiment of the present invention, in which:

FIG. 4*a* is a front view of the shirt;

FIG. 4*b* is a perspective view separately showing a pair of spectacles and the shirt; and FIG. 4*c* is a front view of the shirt with the spectacles being hung on one or the other hanging band or loop;

FIGS. 5*a* to 5*c* are views of a shirt provided with a spectacle hanging band at the stitched lower junction of buttoned and buttonholed parts of the button-down front opening in accordance with the fifth embodiment of the present invention, in which:

FIG. 5*a* is a front view of the shirt;

FIG. 5*b* is a perspective view separately showing a pair of spectacles and the shirt; and FIG. 5*c* is a front view of the shirt with the spectacles being hung on the hanging band;

FIGS. 6*a* to 6*c* are views of a shirt interiorly provided with a spectacle hanging hole at the stitched lower junction of the button-down front opening at a position leaning to a side in accordance with the sixth embodiment of the present invention, in which:

FIG. 6*a* is a front view of the shirt;

FIG. 6*b* is a perspective view separately showing a pair of spectacles and the shirt; and FIG. 6*c* is a front view of the shirt with the spectacles being hung on the hanging hole;

FIGS. 8*a* and 8*b* are views of a shirt exteriorly provided with a spectacle hanging piece at the breast in accordance with the eighth embodiment of the present invention, in which:

FIG. 8*a* is a front view of the shirt; and

FIG. 8*b* is a perspective view of a pair of spectacles being hung on the hanging piece; and FIGS. 9*a* and 9*b* are views individually showing a pair of spectacles hung on a typical shirt, in which:

FIG. 9*a* is a front view of the typical shirt with the spectacles being hung on the stitched lower junction of the button-down front opening; and FIG. 9*b* is a front view of the typical shirt with the spectacles being hung on the pocket.

DESCRIPTION OF THE PREFERRED EMBODIMENTS

In the following embodiments, the spectacle hanging device of this invention is formed on, for example, a sport shirt that is a garment for the upper part of the body. However, it should be understood that the spectacle hanging device of this invention may be formed on another type of garment, such as a blouse, trousers, etc., without affecting the functioning of this invention.

The device for hanging spectacles on the shirt comprises a spectacle hanging means, which is formed at one or more of the neck, breast, pocket, and button-down openings of the shirt and selectively holds an arm of the spectacles so as to hang the spectacles on the shirt.

Figure 1A:
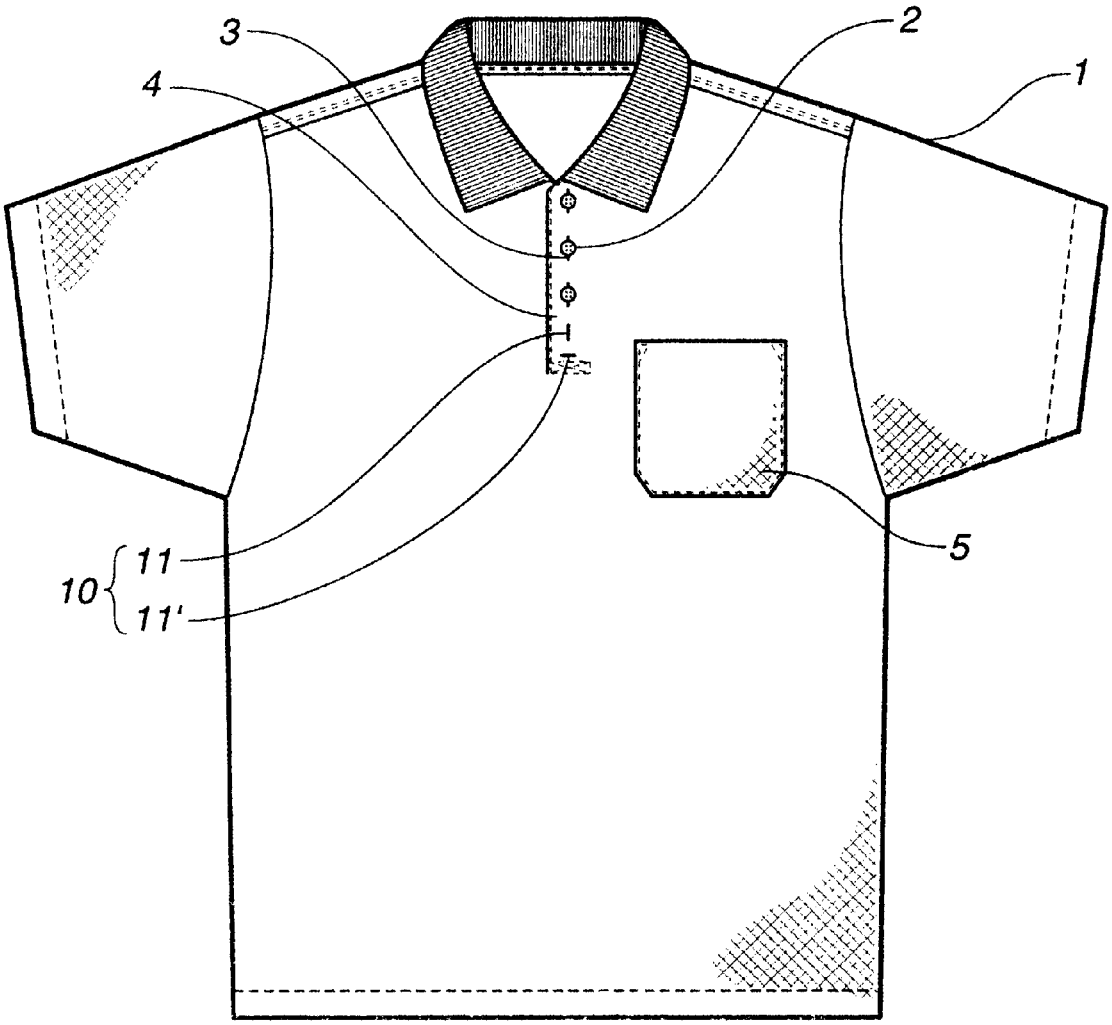
Figure 1B:
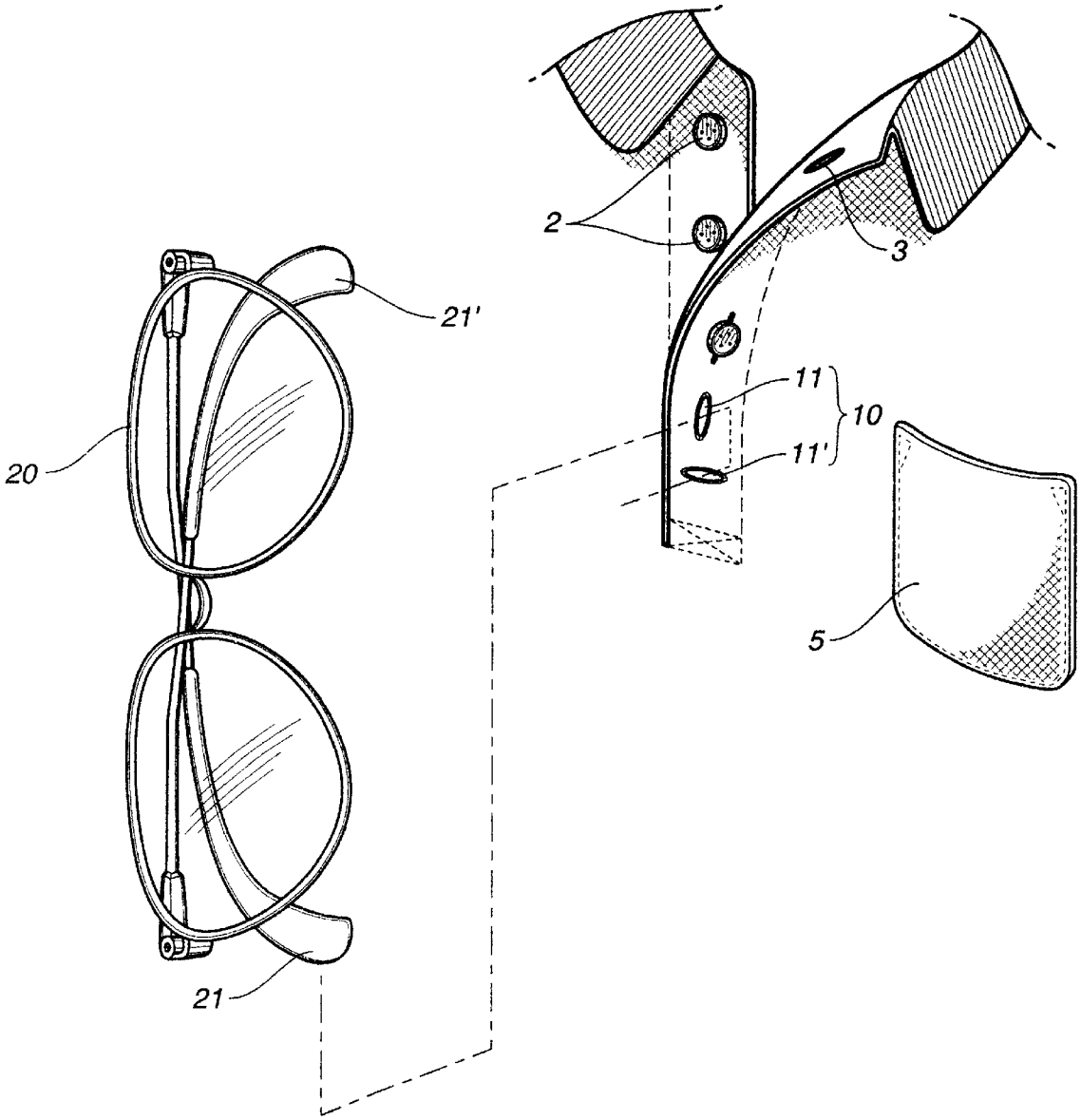
Figure 1C:
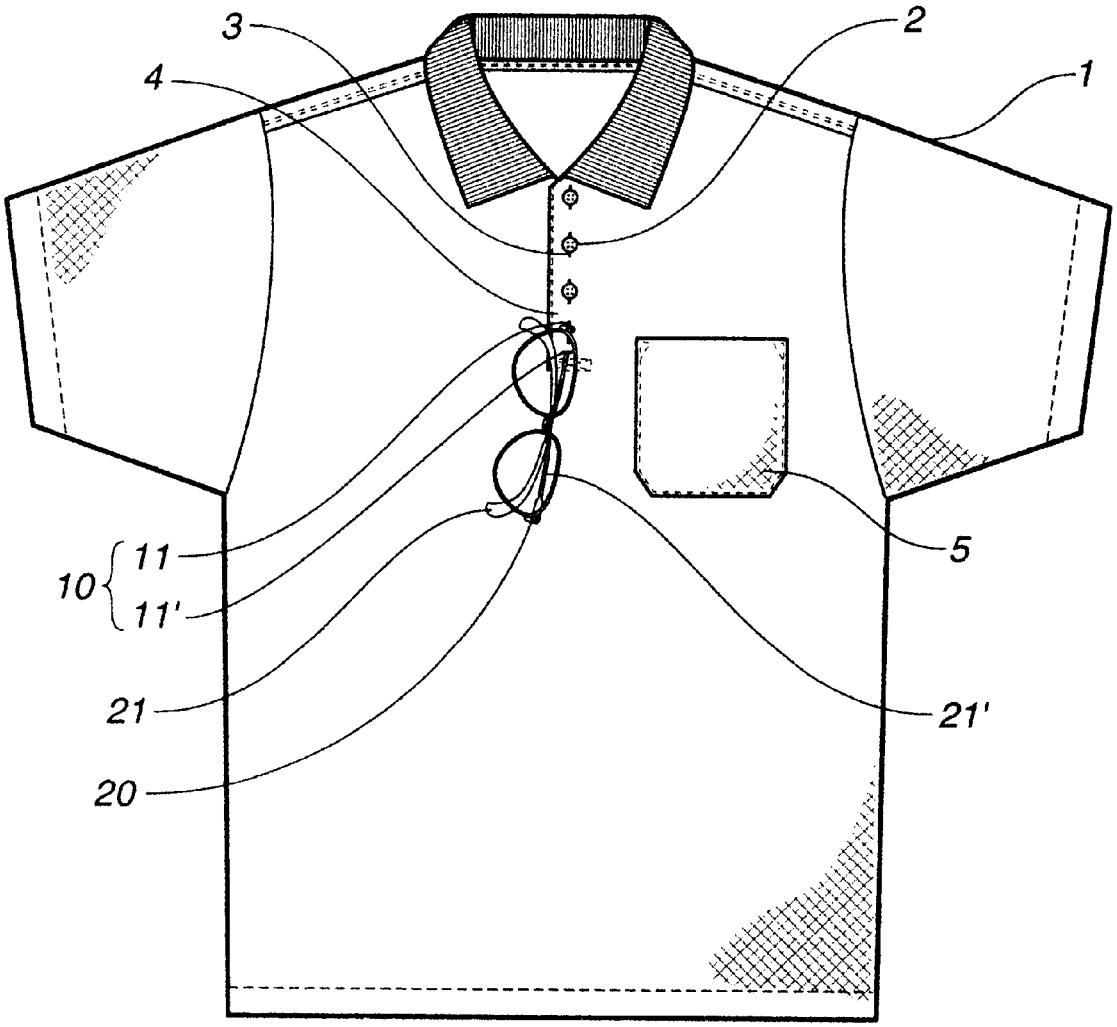

In the primary embodiment of FIGS. 1*a* to 1*c*, the spectacle hanging means 10 is provided at the button-down front opening 4 of the shirt 1. The above shirt 1 has the button-down front opening 4 and at least one pocket 5 in a conventional manner. The front opening 4 is formed at a position from the neck to the center of the breast and comprises a buttoned part and a buttonholed part which are integrated at a stitched lower junction. A plurality of buttons 2 are sewn on the buttoned part along the length of the part, while a plurality of buttonholes 3 are formed on the buttonholed part at positions corresponding to the buttons 2. In the primary embodiment, the spectacle hanging means 10 comprises two slits: vertical and horizontal slits 11 and 11'. The vertical slit 11 is formed at a lower portion of the buttonholed part of the front opening 4 and allows an arm 21 of a pair of spectacles 20 to be inserted into the buttonholed part. The horizontal slit 11' is formed on the buttonholed part at a position vertically and downwardly spaced apart from the vertical slit 22 by a distance and allows the arm 21 to stick out of the buttonholed part.

Figure 2A:
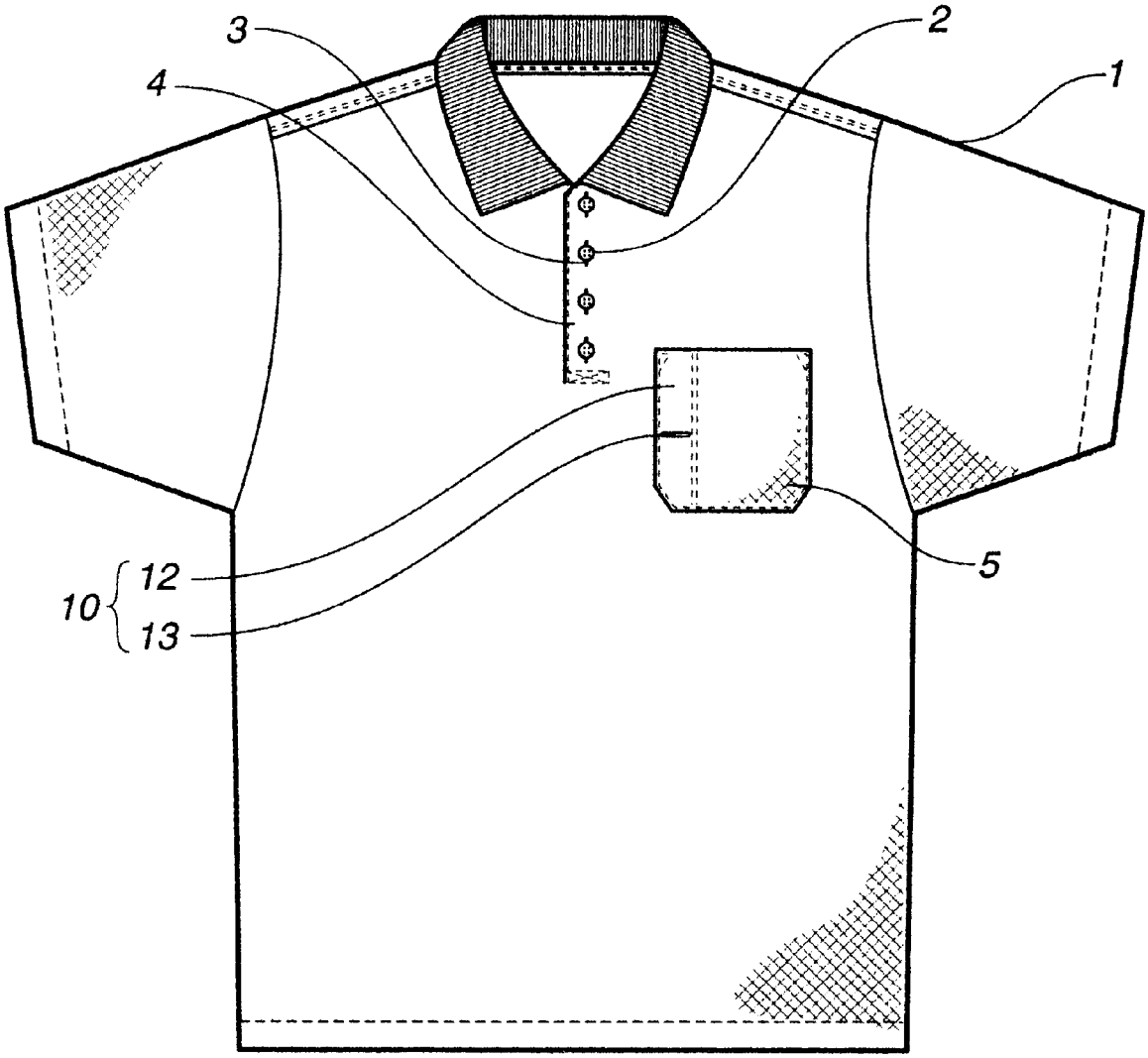
Figure 2B:
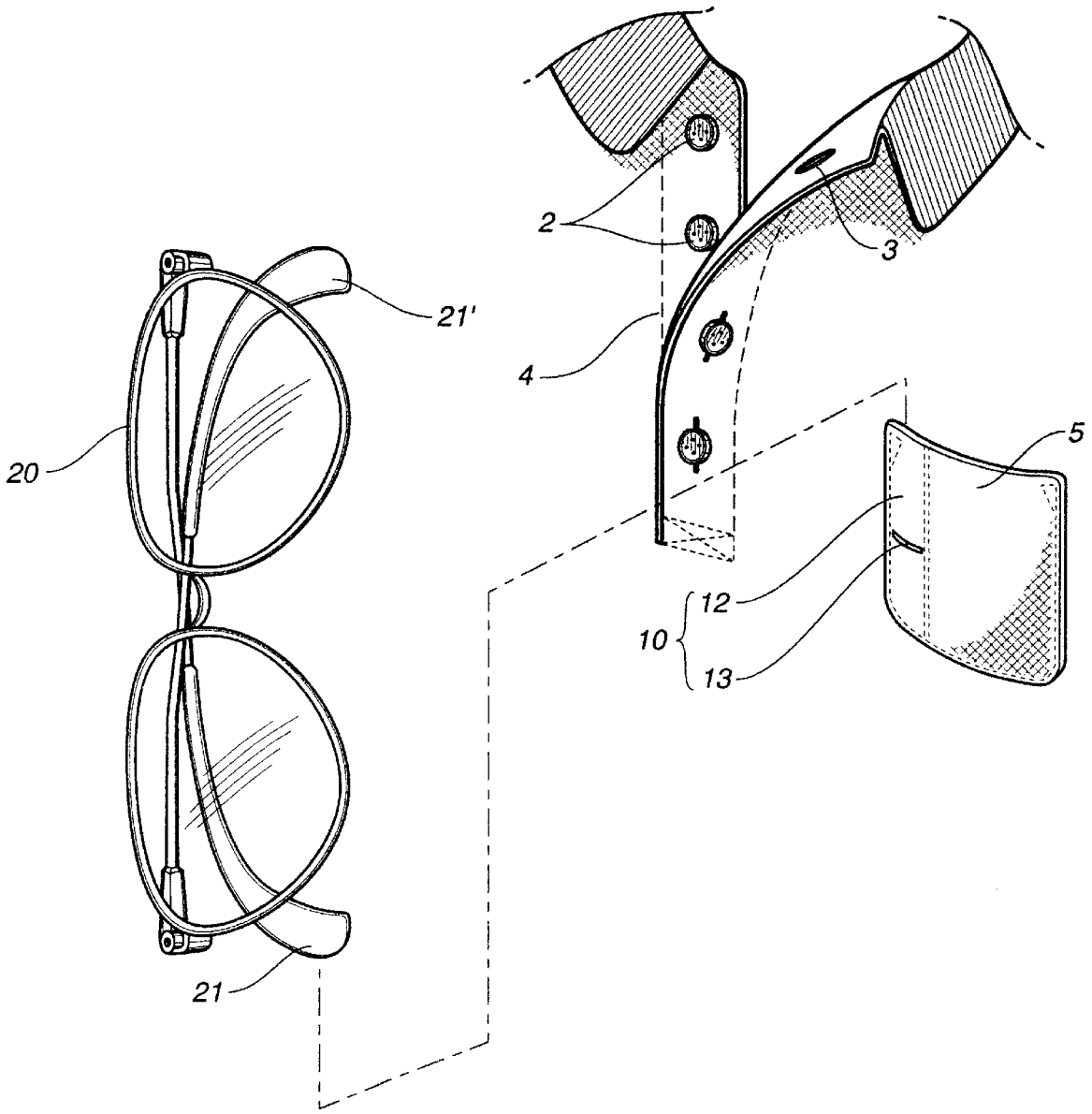
Figure 2C:
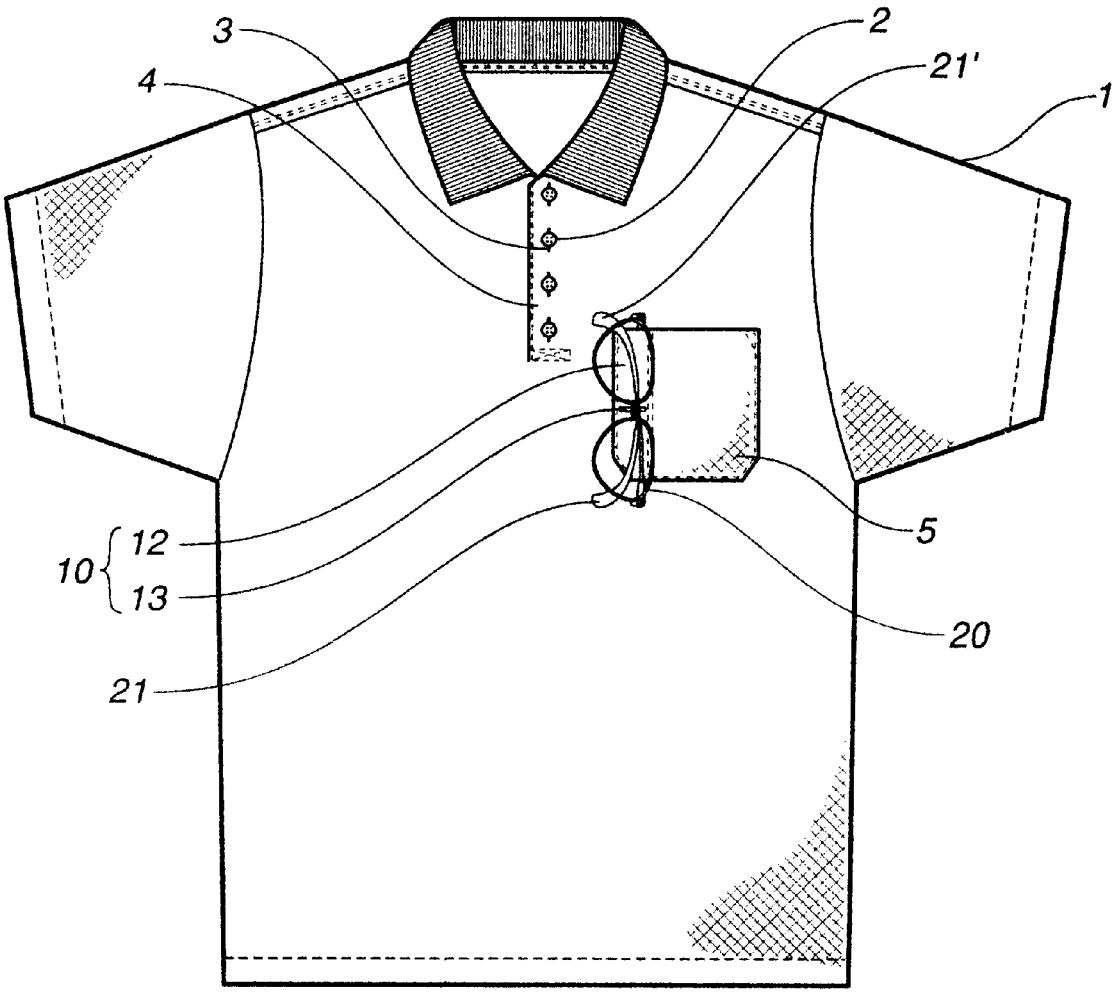

FIGS. 2*a* to 2*c* show a shirt 1 provided with a spectacle hanging means in accordance with the second embodiment of this invention. In the second embodiment, the spectacle hanging means 10 comprises a narrow spectacle-arm fob 12 which is formed by sewing the pocket 5 to the body of the shirt 1 along a vertical line spaced apart from the inside edge of the pocket 5 by a predetermined width. The spectacle-arm fob 12 has a horizontal slit 13 at a middle portion, so an arm 21 of a pair of spectacles 20 may be inserted into the fob 12 at a top edge of the fob 12 and stick out of the fob 12 through the horizontal slit 13.

Figure 3A:
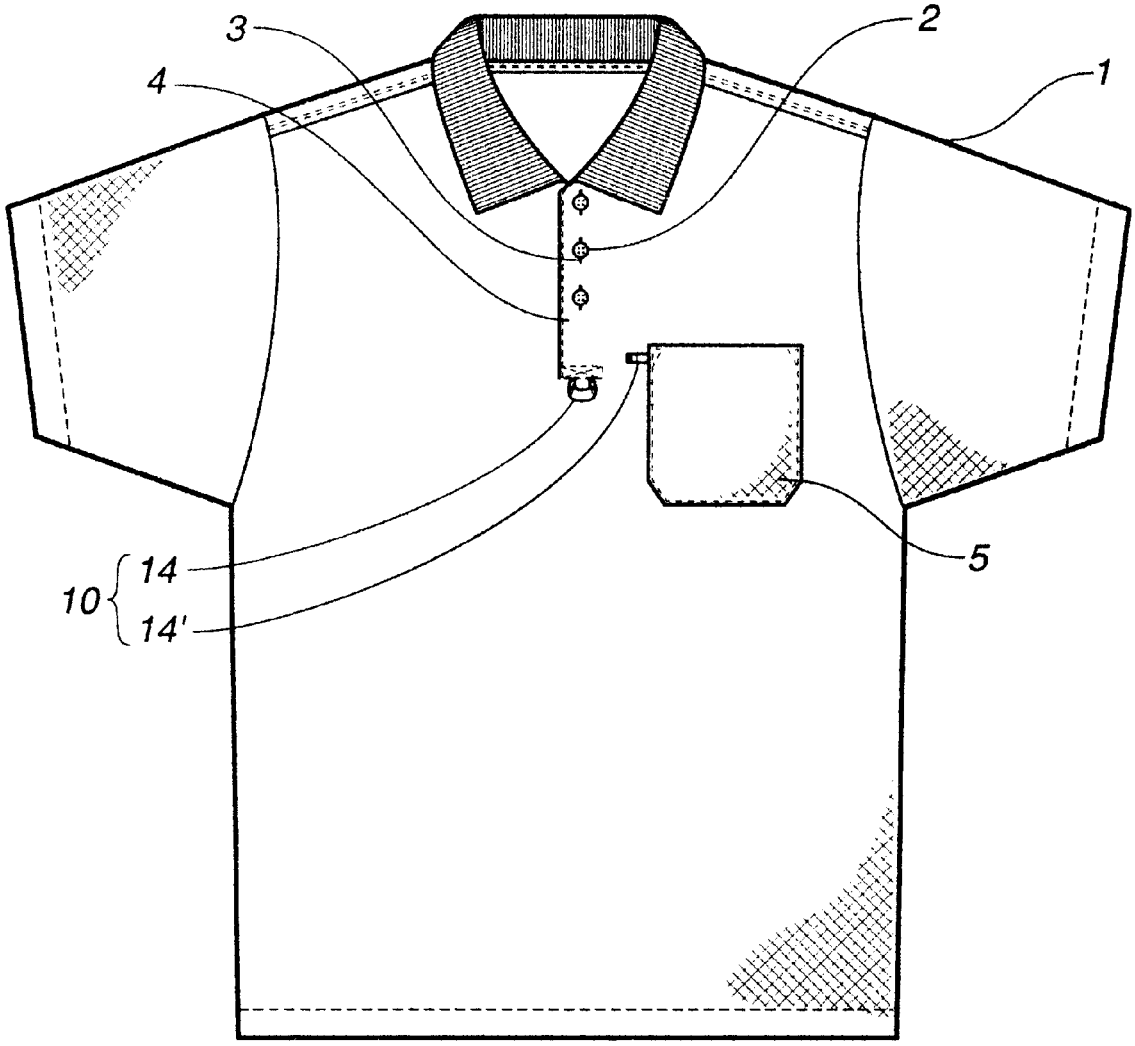
Figure 3B:
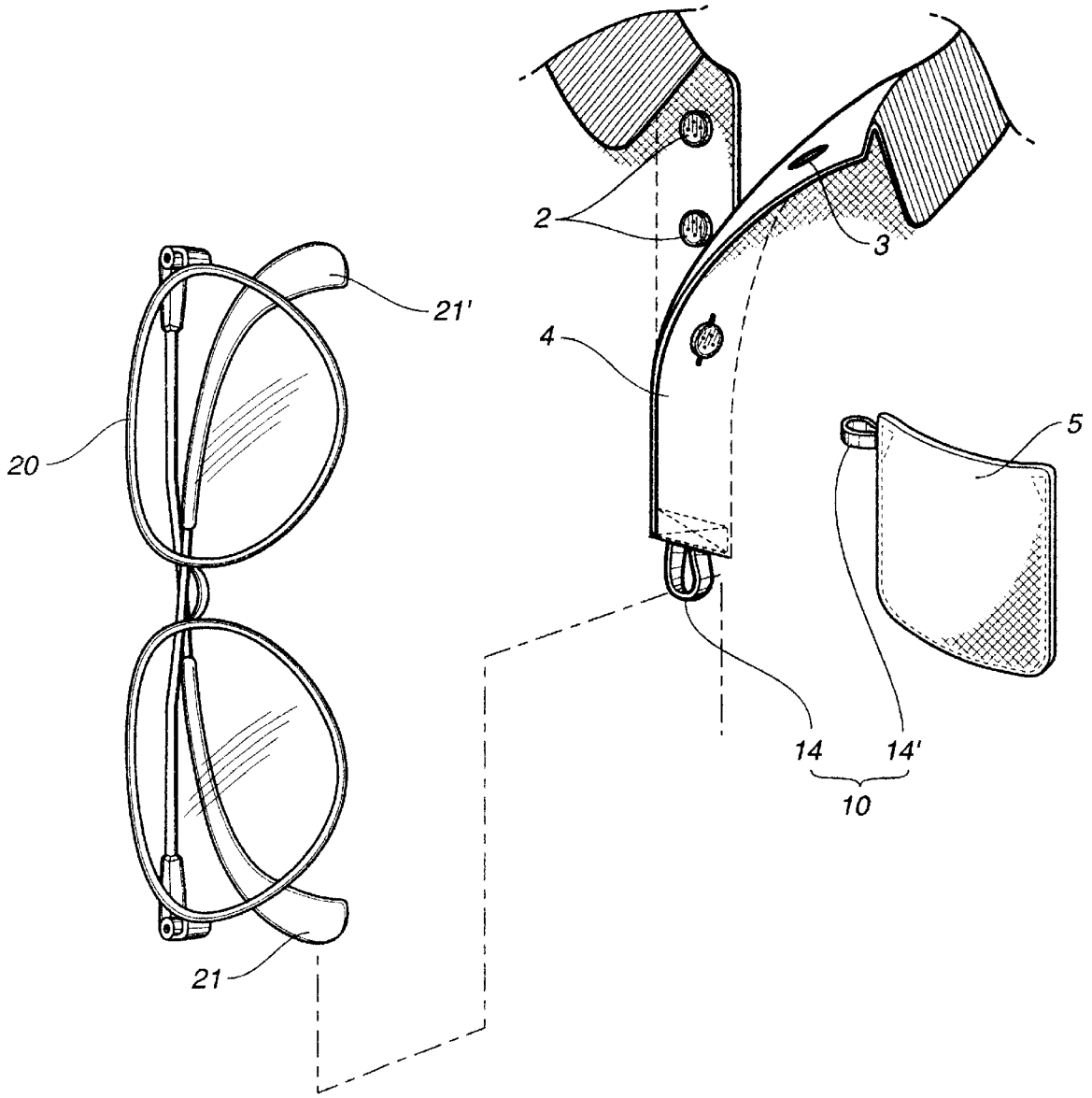
Figure 3C:
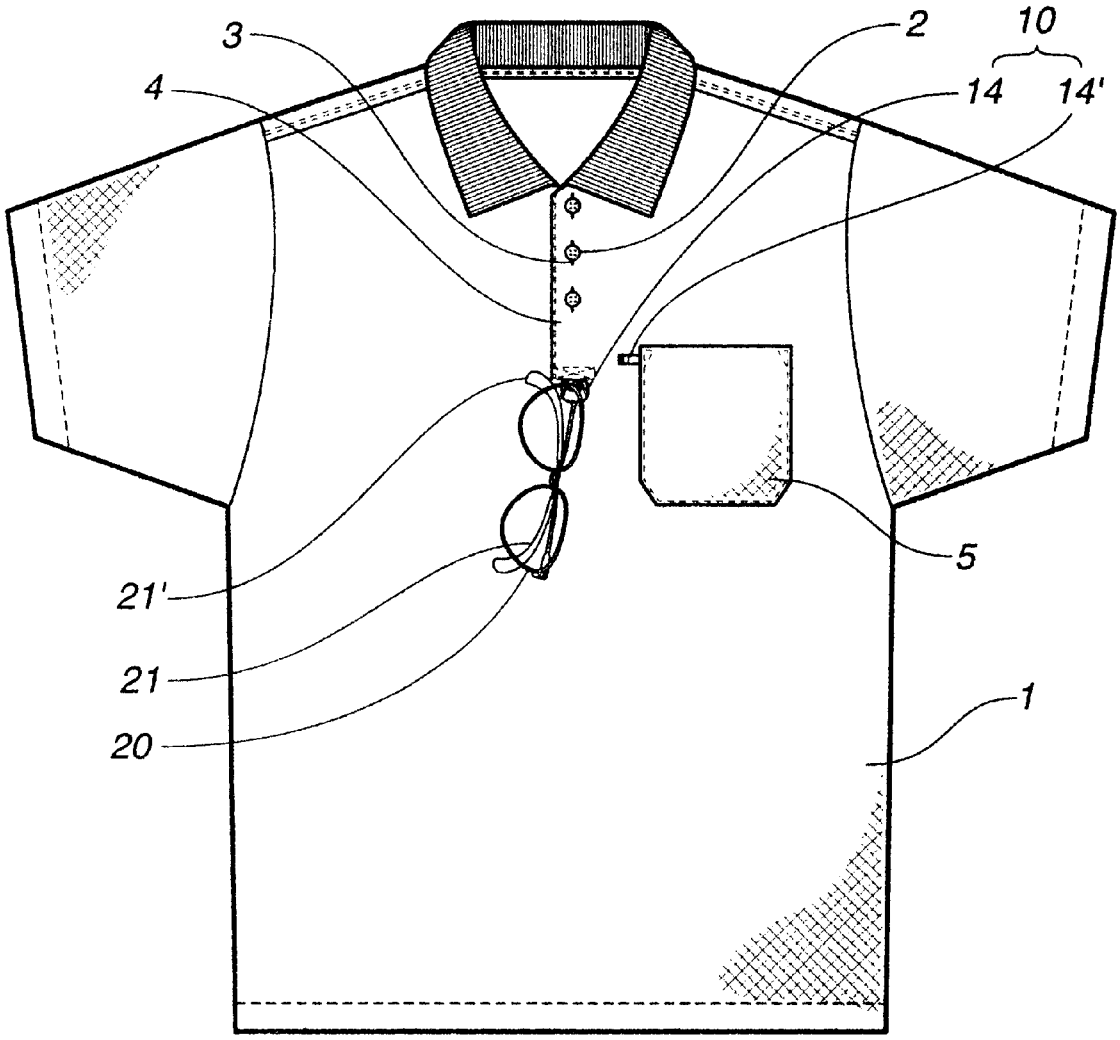

In the third embodiment of FIGS. 3*a* to 3*c*, the spectacle hanging means 10 comprises first and second spectacle hanging loops 14 and 14'. The two loops 14 and 14', made of an elastic material, are exteriorly provided at the stitched lower junction of the buttoned and buttonholed parts of the front opening 4 and a side edge of the pocket 5, respectively, and selectively receive an arm 21 of a pair of spectacles 20 so as to hang the spectacles 20 on the shirt 1. In this embodiment, the elastic material for the loops 14 and 14' is selected from elastic narrow fabrics and elastic braids.

Figure 4A:
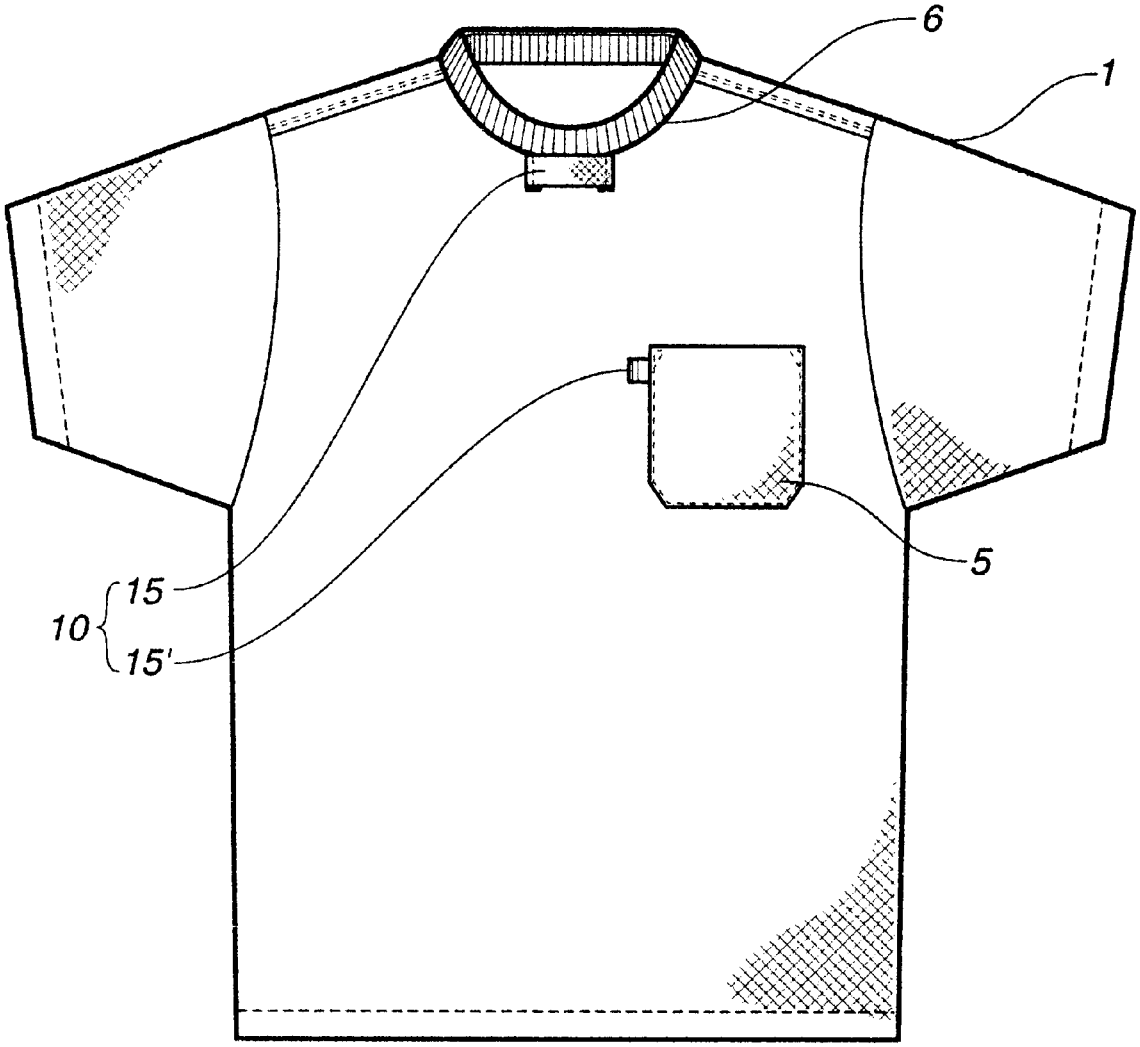
Figure 4B:
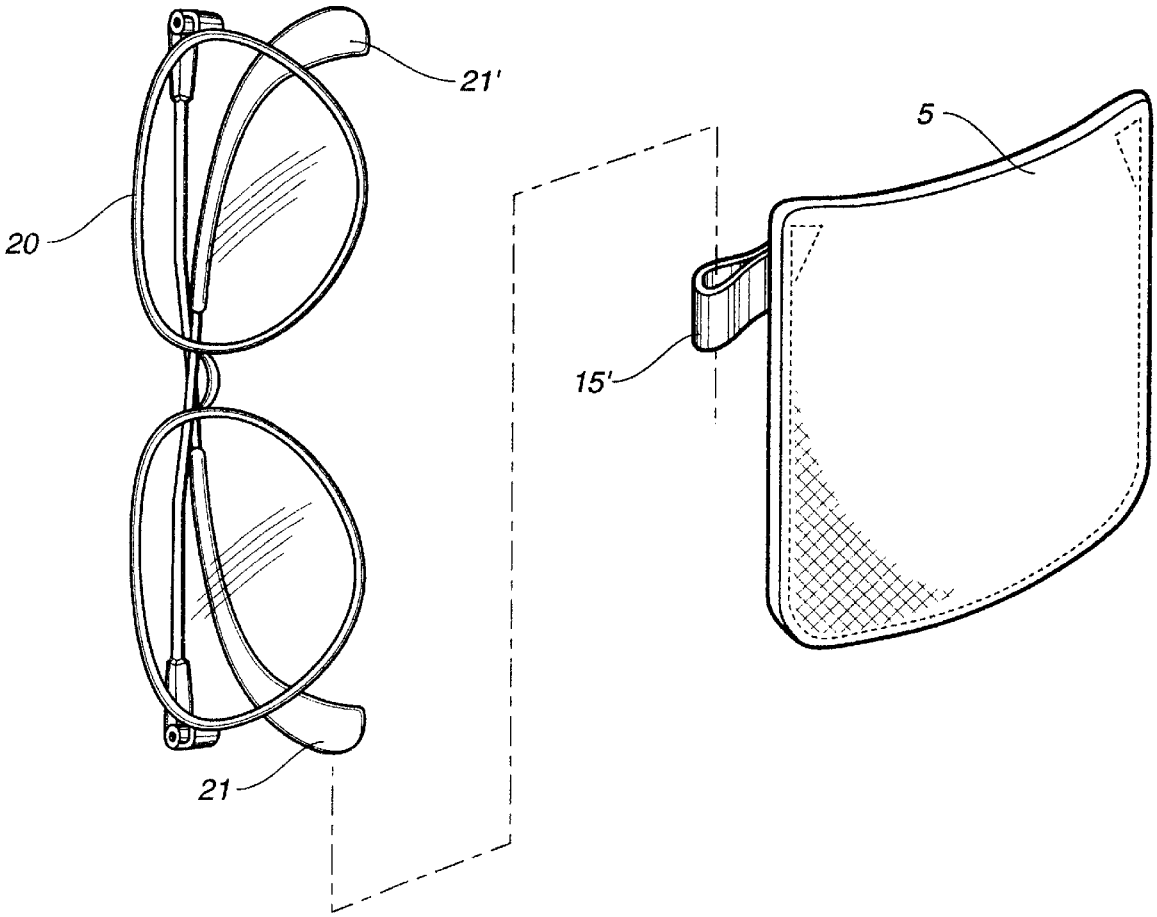
Figure 4C:
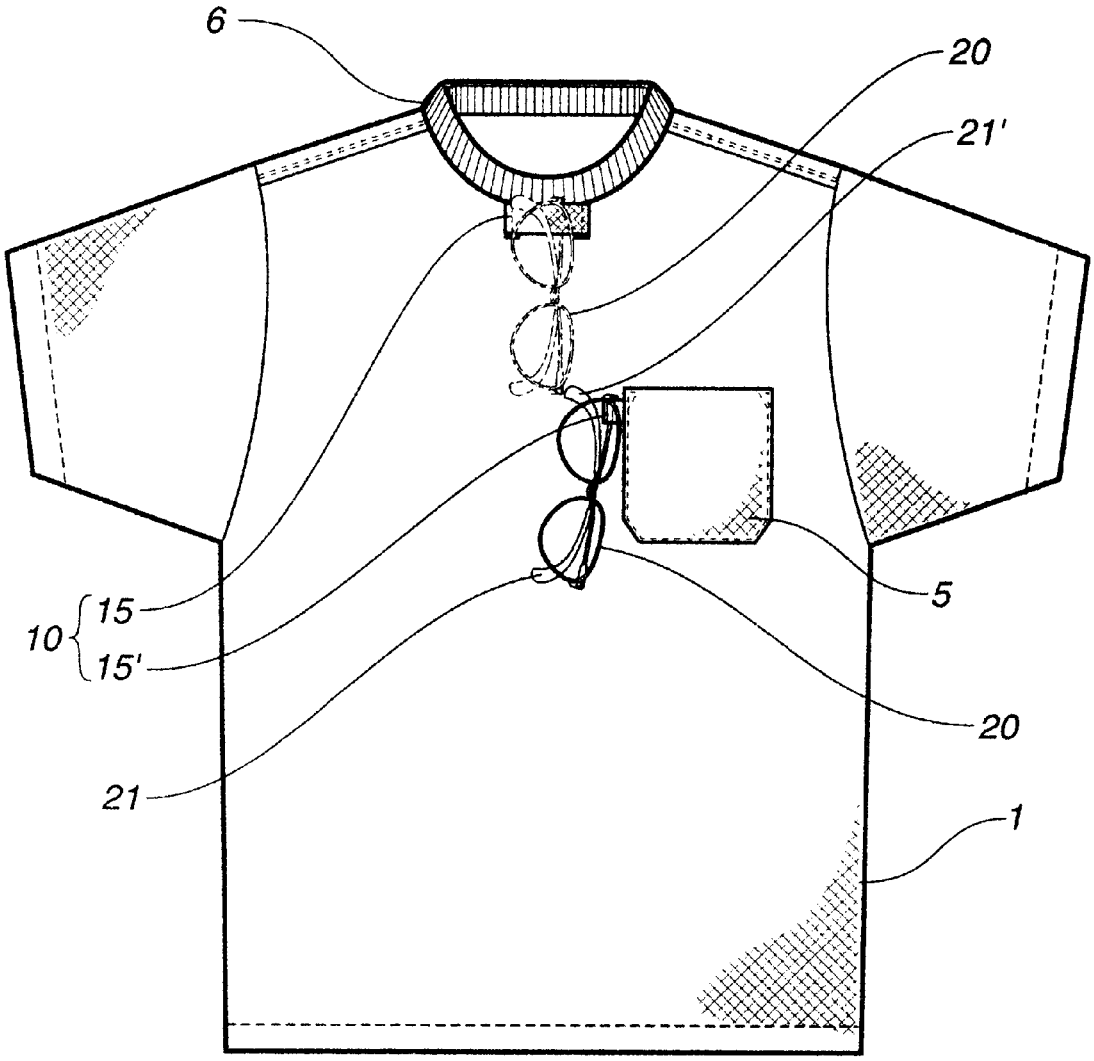

FIGS. 4*a* to 4*c* show a shirt 1 provided with a spectacle hanging means in accordance with the fourth embodiment of this invention. The above shirt 1 has a round neck 6, thus being free from a button-down opening 4 or a collar different from the above-mentioned embodiments. In the fourth embodiment, the spectacle hanging means 10 comprises a spectacle hanging band and loop 15 and 15', which are exteriorly provided at the front bottom of the round neck 6 and the inside edge of the pocket 5, respectively. The band and loop 15 and 15' selectively receive an arm 21 of a pair of spectacles 20 so as to hang the spectacles 20 on the shirt 1.

Figure 5A:
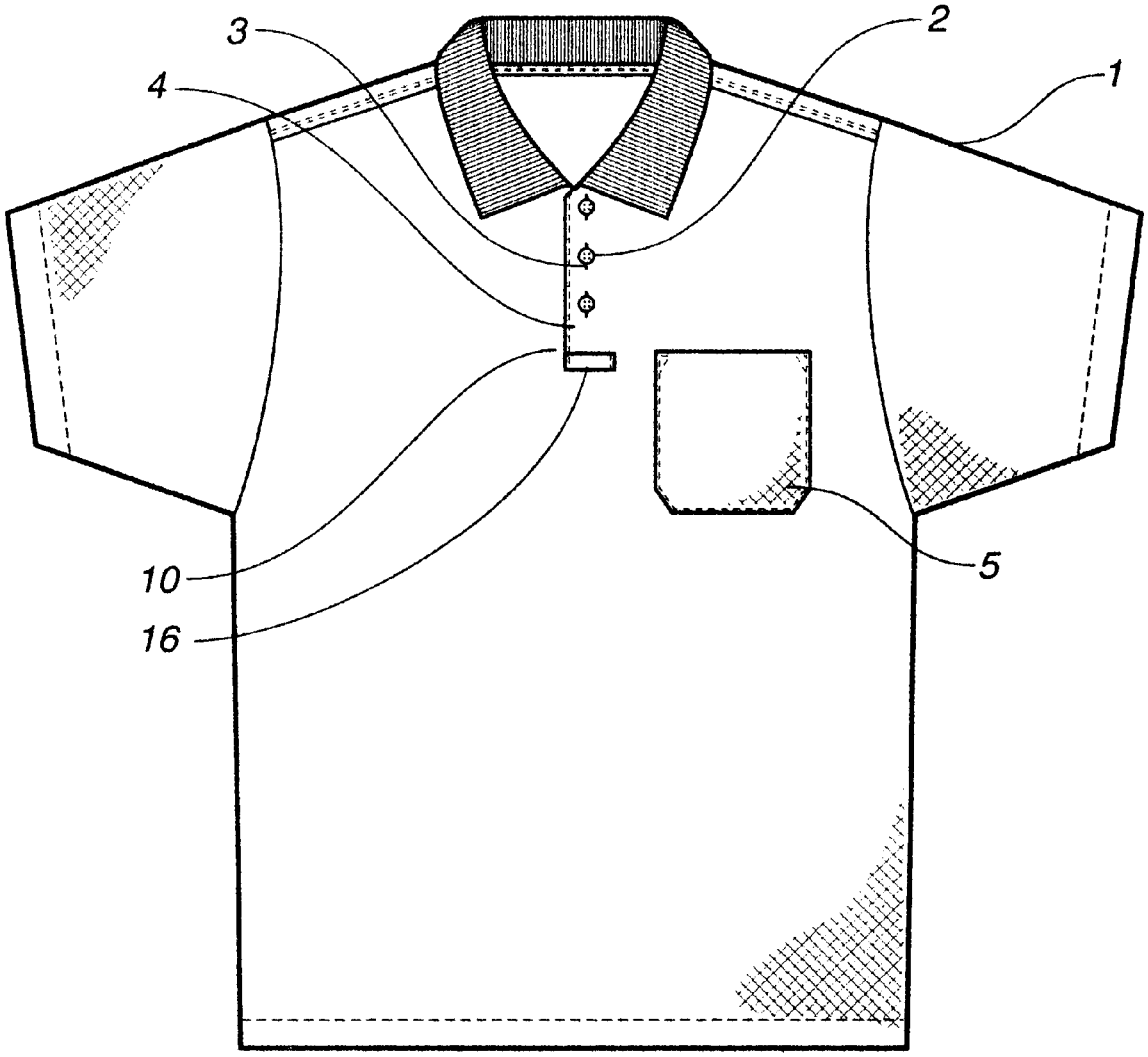
Figure 5B:
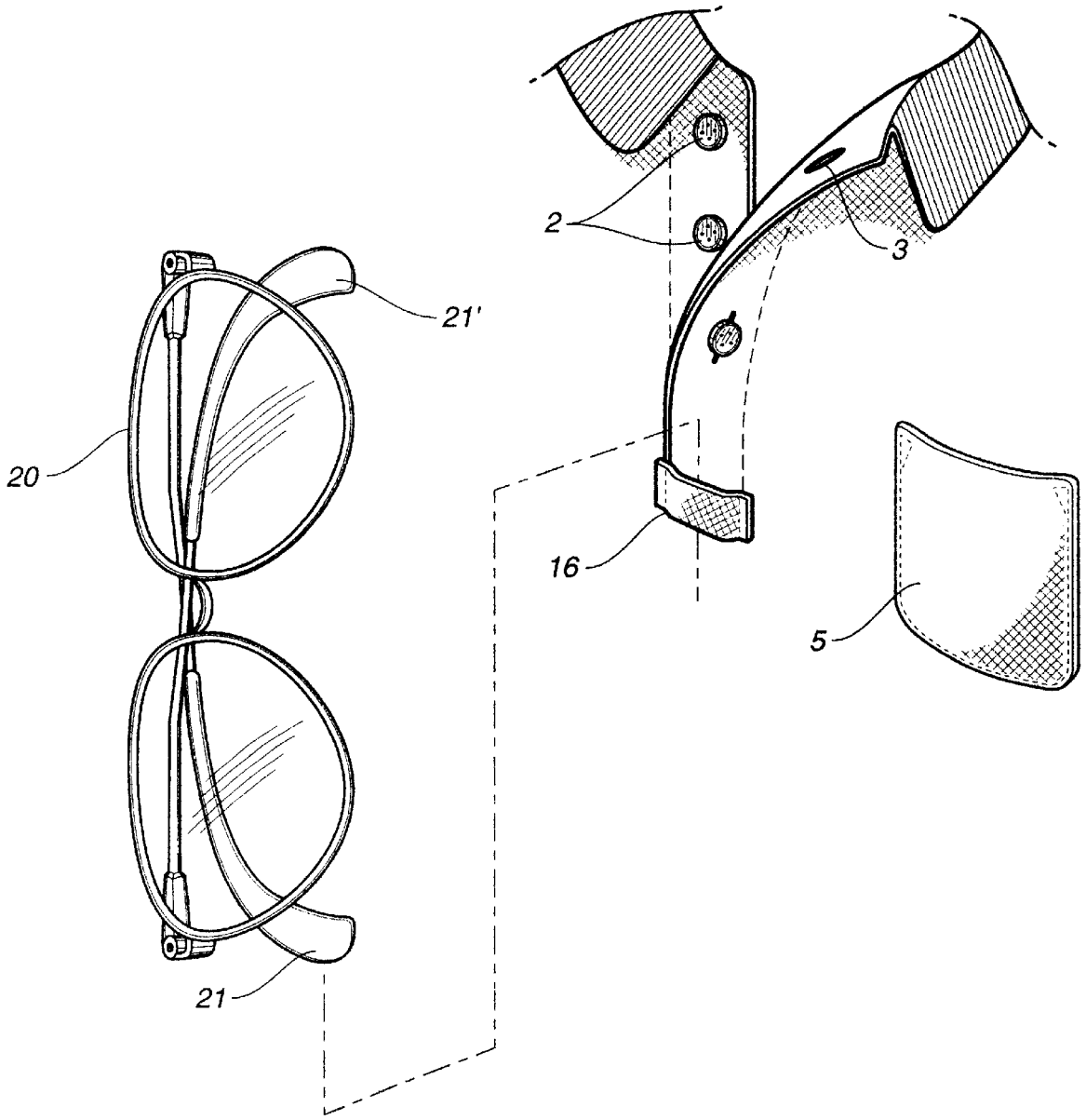
Figure 5C:
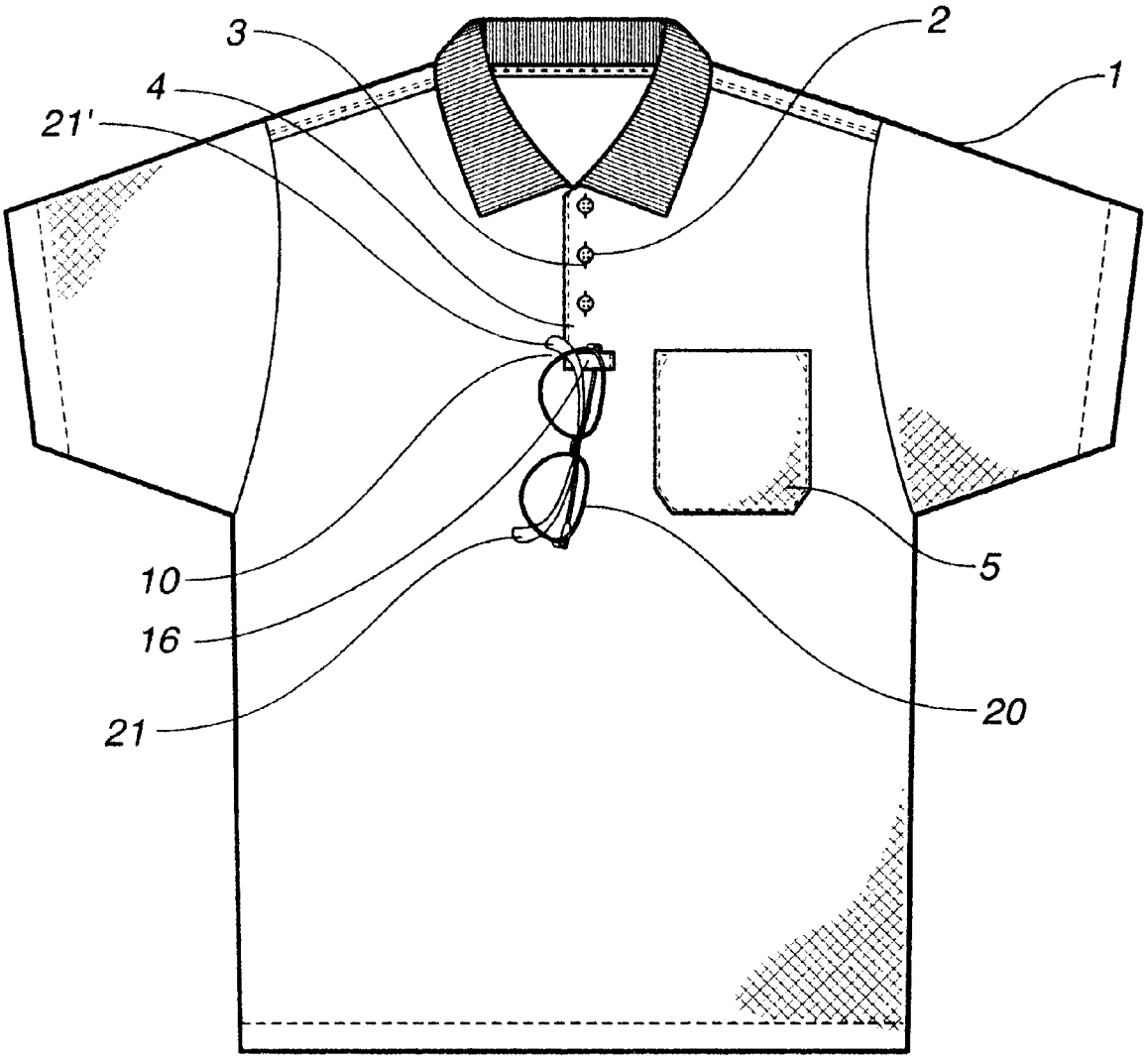

FIGS. 5*a* to 5*c* show a shirt 1 provided with a spectacle hanging means in accordance with the fifth embodiment of this invention. In the fifth embodiment, the spectacle hanging means 10 comprises a spectacle hanging band 16 which is exteriorly sewn to the stitched lower junction of the front opening 4 at its both ends. The band 16 selectively receives an arm 21 of a pair of spectacles 20 so as to hang the spectacles 20 on the shirt 1.

Figure 6A:
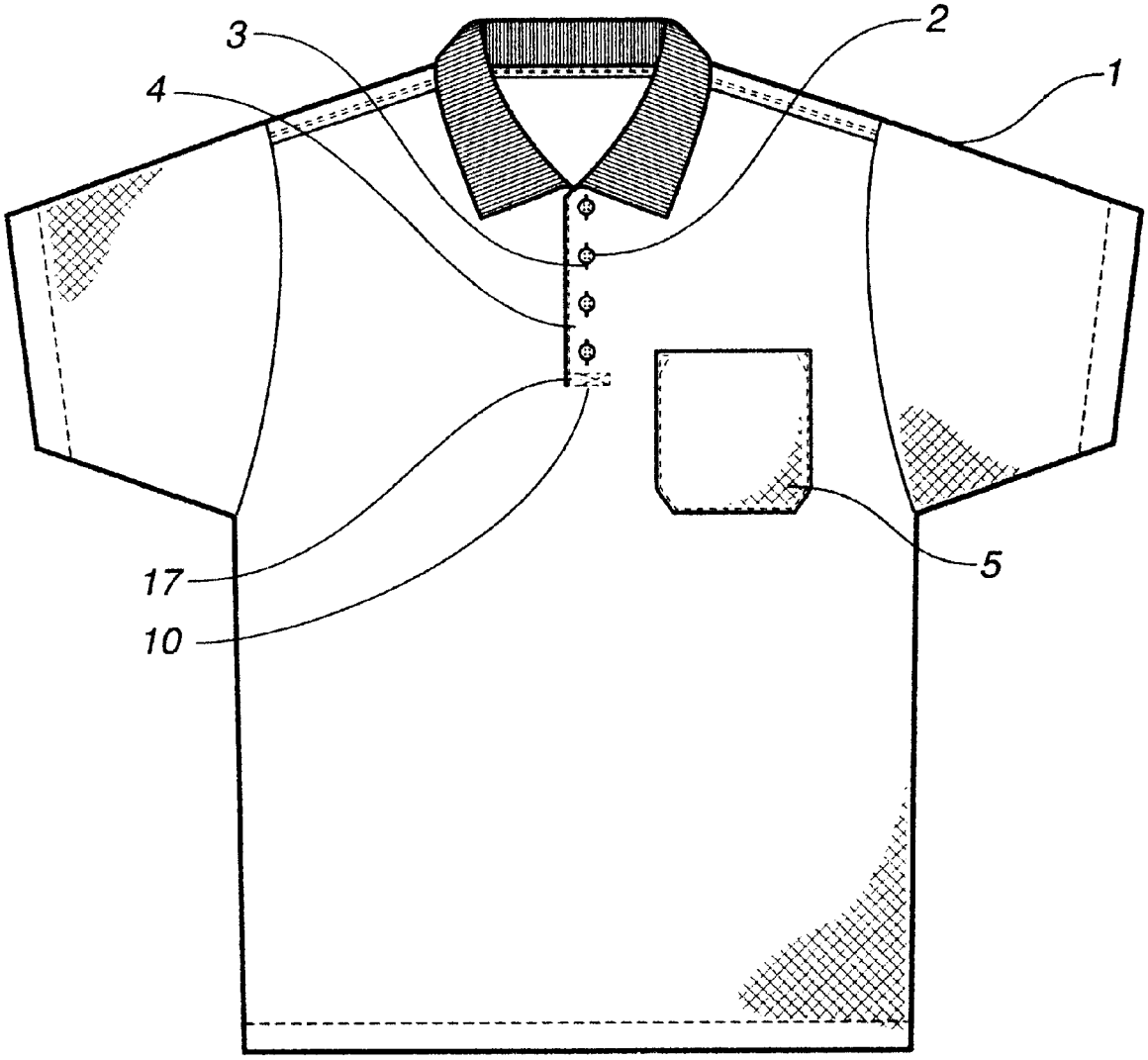
Figure 6B:
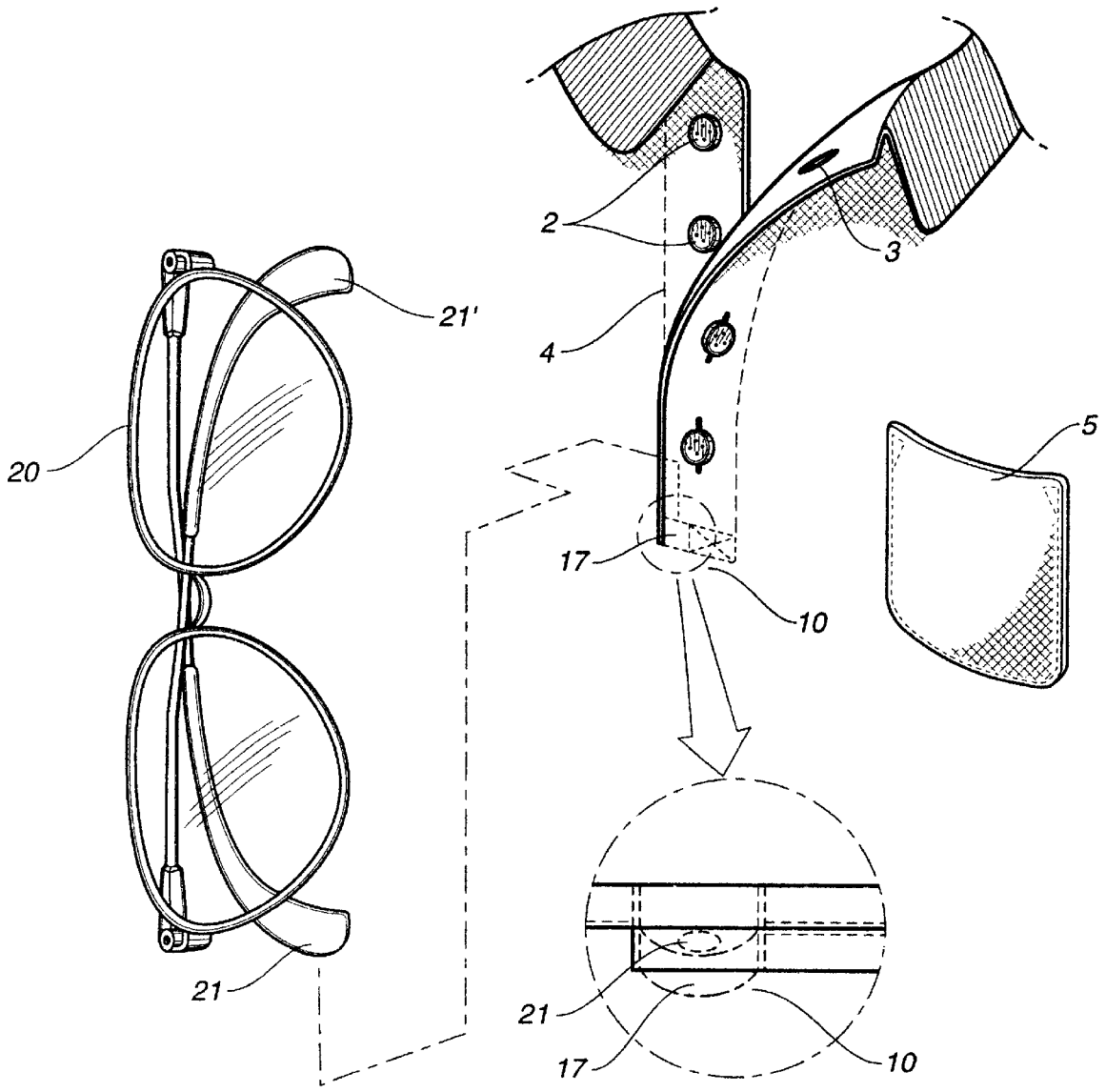
Figure 6C:
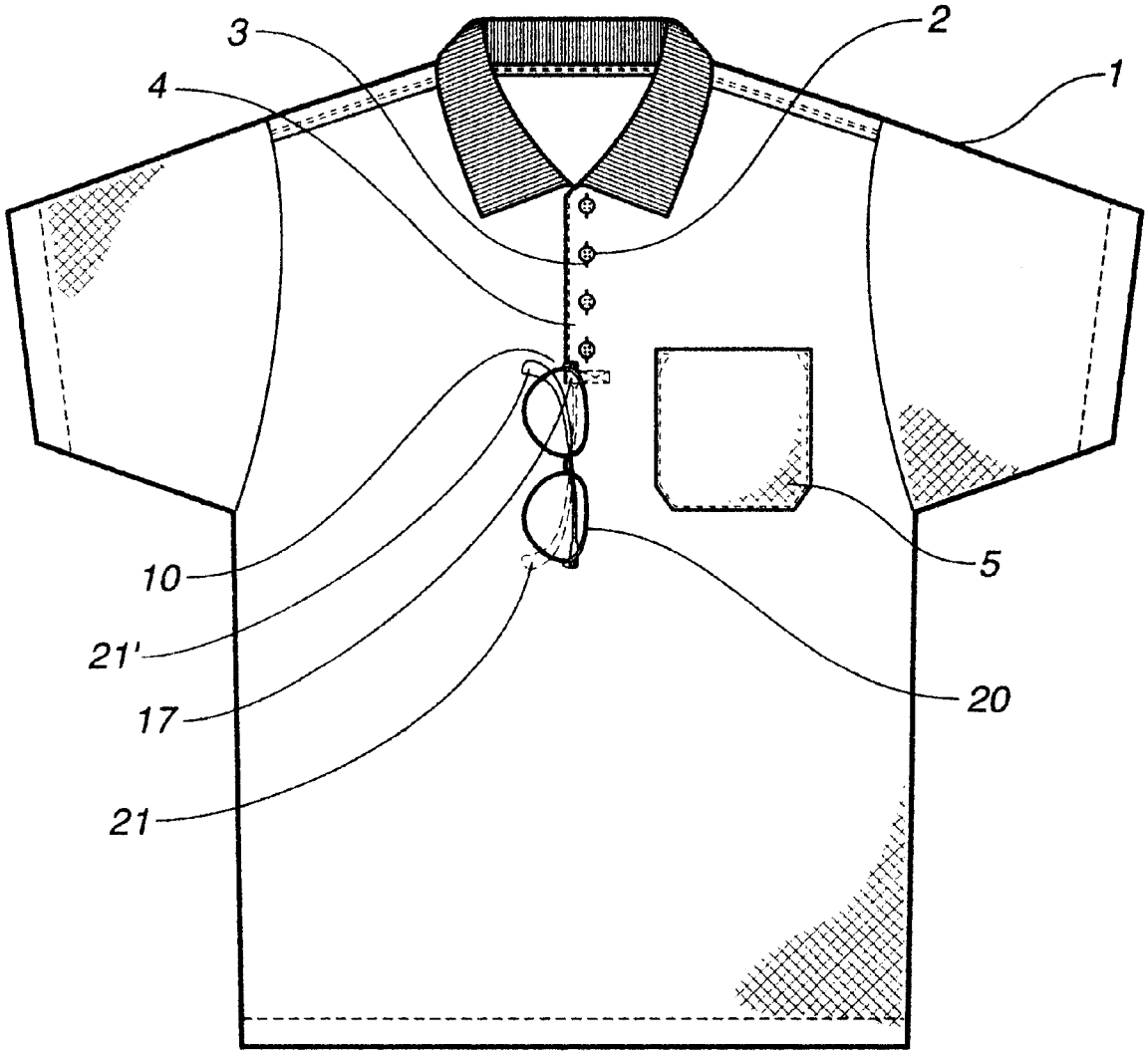

FIGS. 6*a* to 6*c* show a shirt 1 provided with a spectacle hanging means in accordance with the sixth embodiment of this invention. In the sixth embodiment, the spectacle hanging means 10 comprises a vertical hole 17, which is interiorly formed on the stitched lower junction of the front opening 4 by partially sewing the lower ends of the buttoned and buttonholed parts together in a way such that the vertical hole 17 remains on the stitched lower junction at a position slanted to a side. The vertical hole 17 selectively receives an arm 21 of a pair of spectacles 20 so as to hang the spectacles 20 on the shirt 1 with the arm 21 being positioned inside the shirt 1.

In the seventh embodiment of FIG. 7, the spectacle hanging hole, formed at the stitched lower junction of the button-down front opening 4 of the shirt 1, is altered as follows. The vertical hole 17', according to the seventh embodiment, is interiorly formed on the stitched lower junction of the front opening 4 by partially sewing the lower ends of the buttoned and buttonholed parts together in a way such that the vertical hole 17' remains on the central portion of the stitched lower junction of the front opening 4 with two decoratively stitched parts 17*a* and 17*b* being formed at both sides of the hole 17'. A pair of spectacles 20 may be hung on the shirt 1 by the hole 17' in the same manner as that described for the sixth embodiment.

Figure 8A:
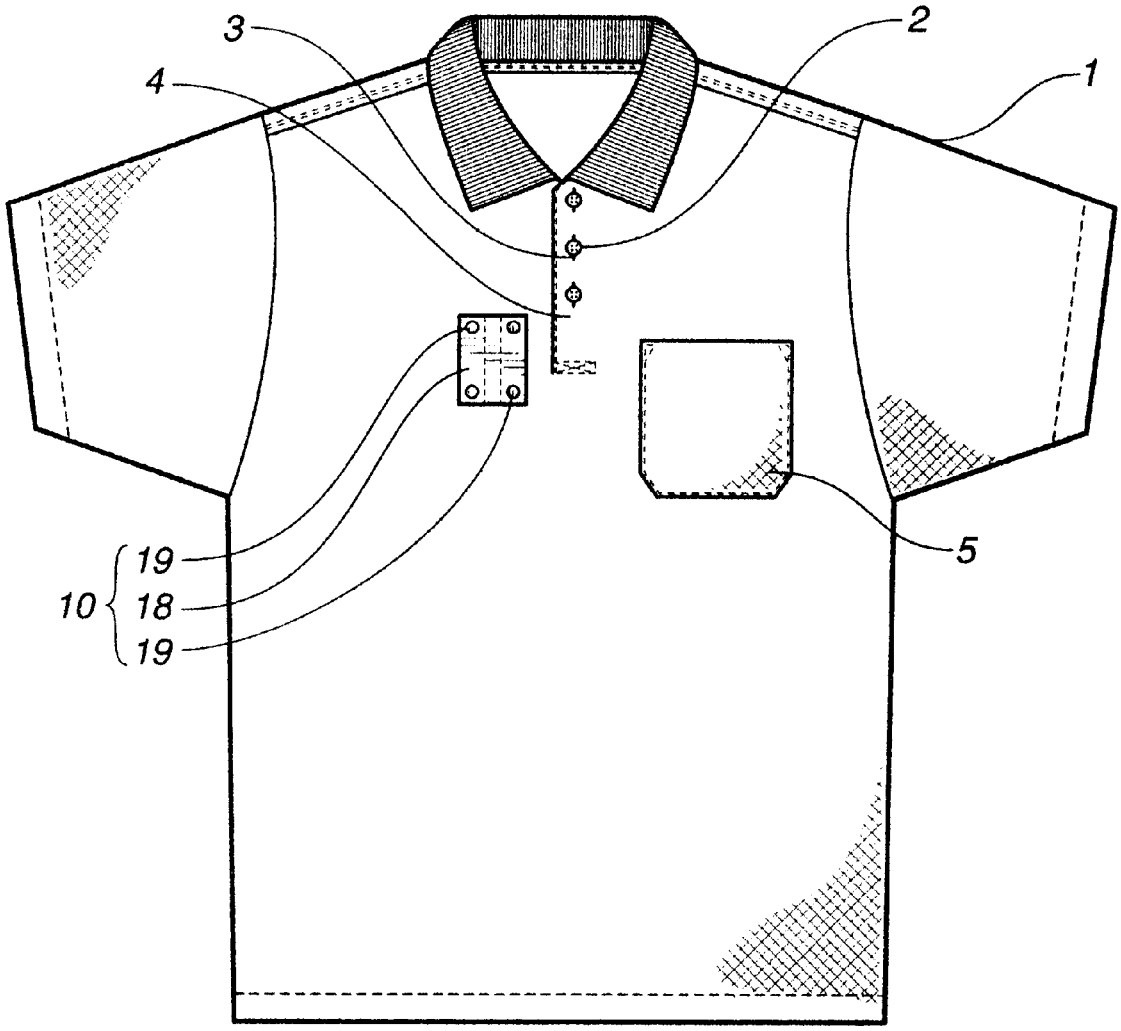
Figure 8B:
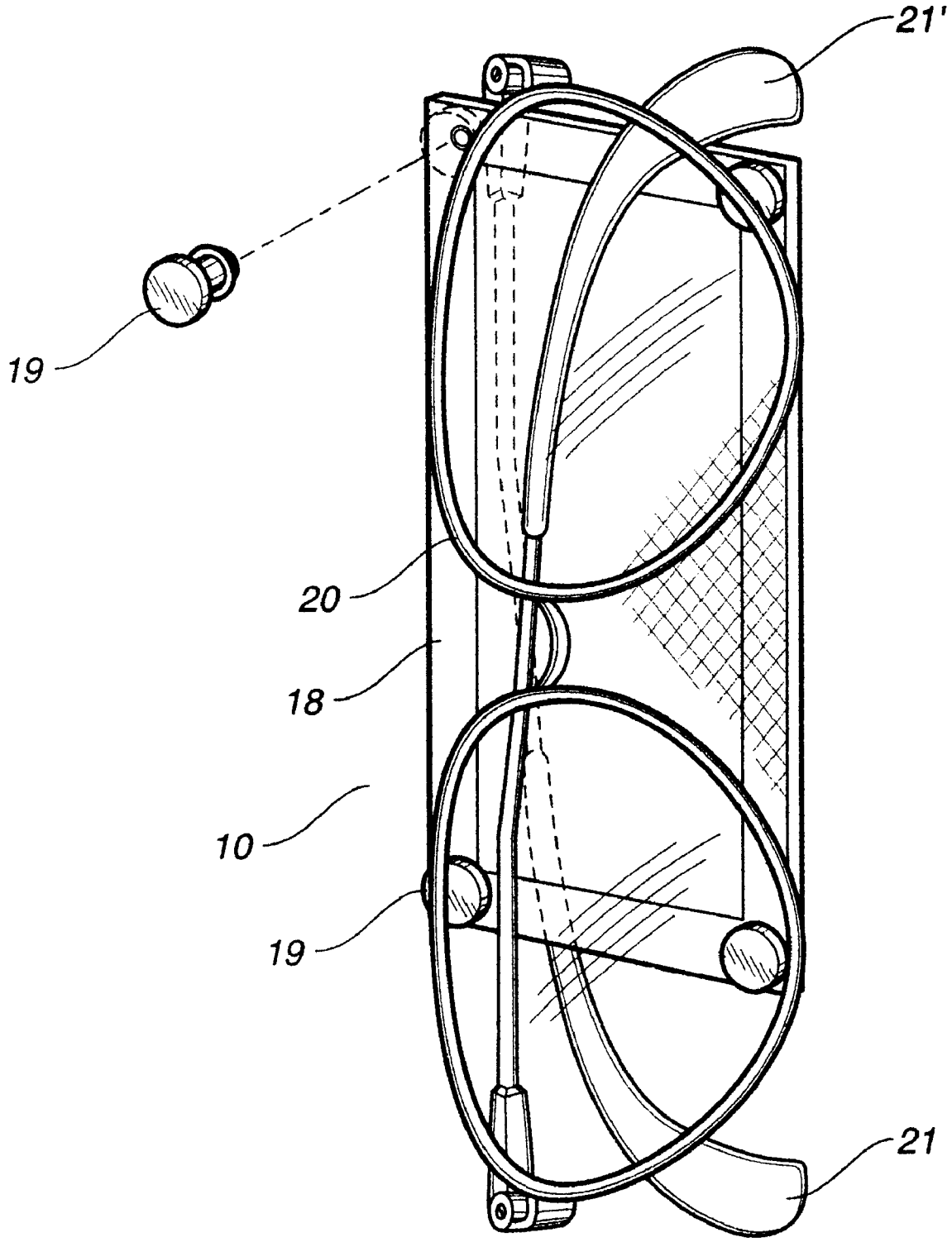
Figure 9A:
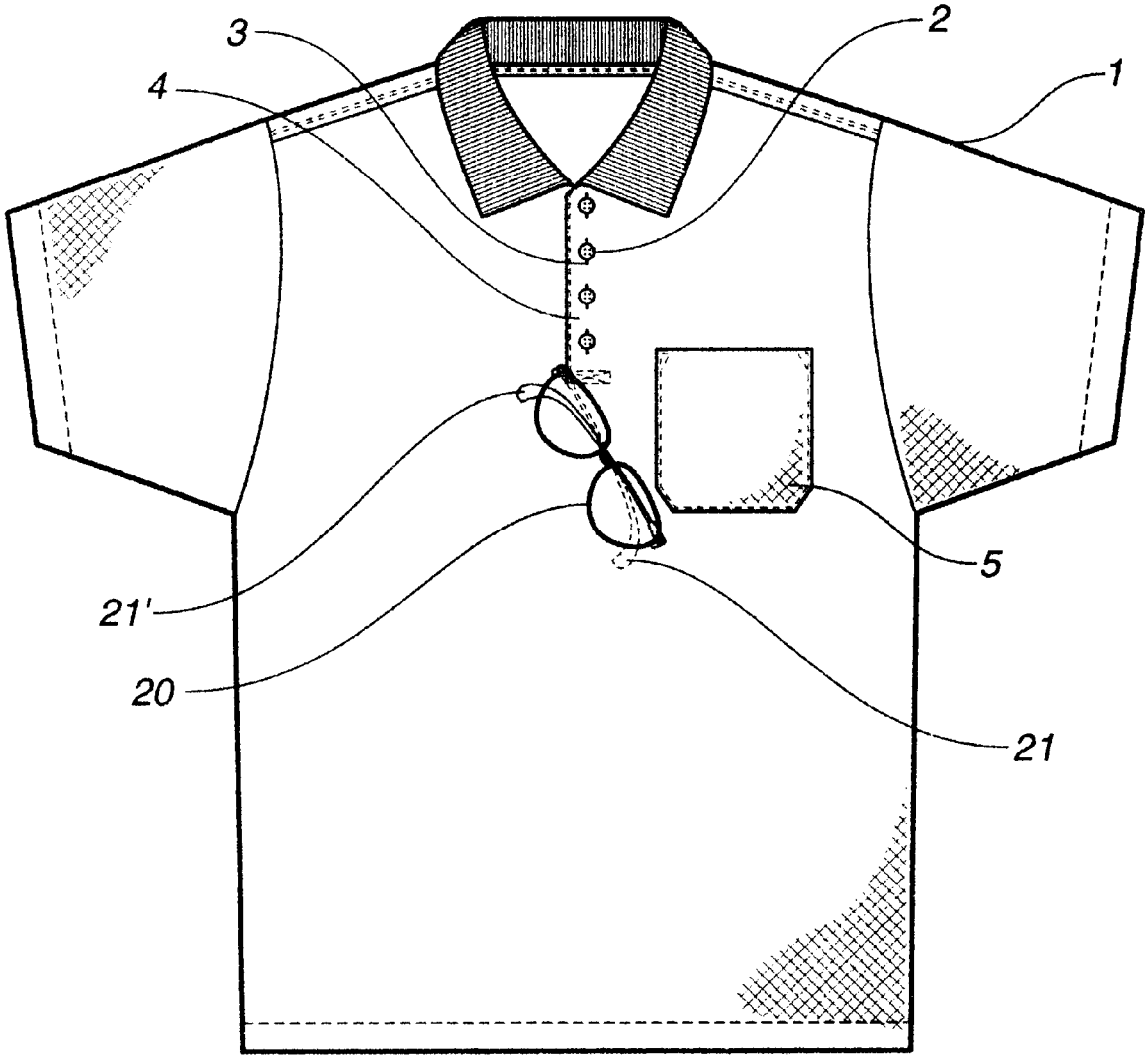
FIG. 9A Prior Art
Figure 9B:
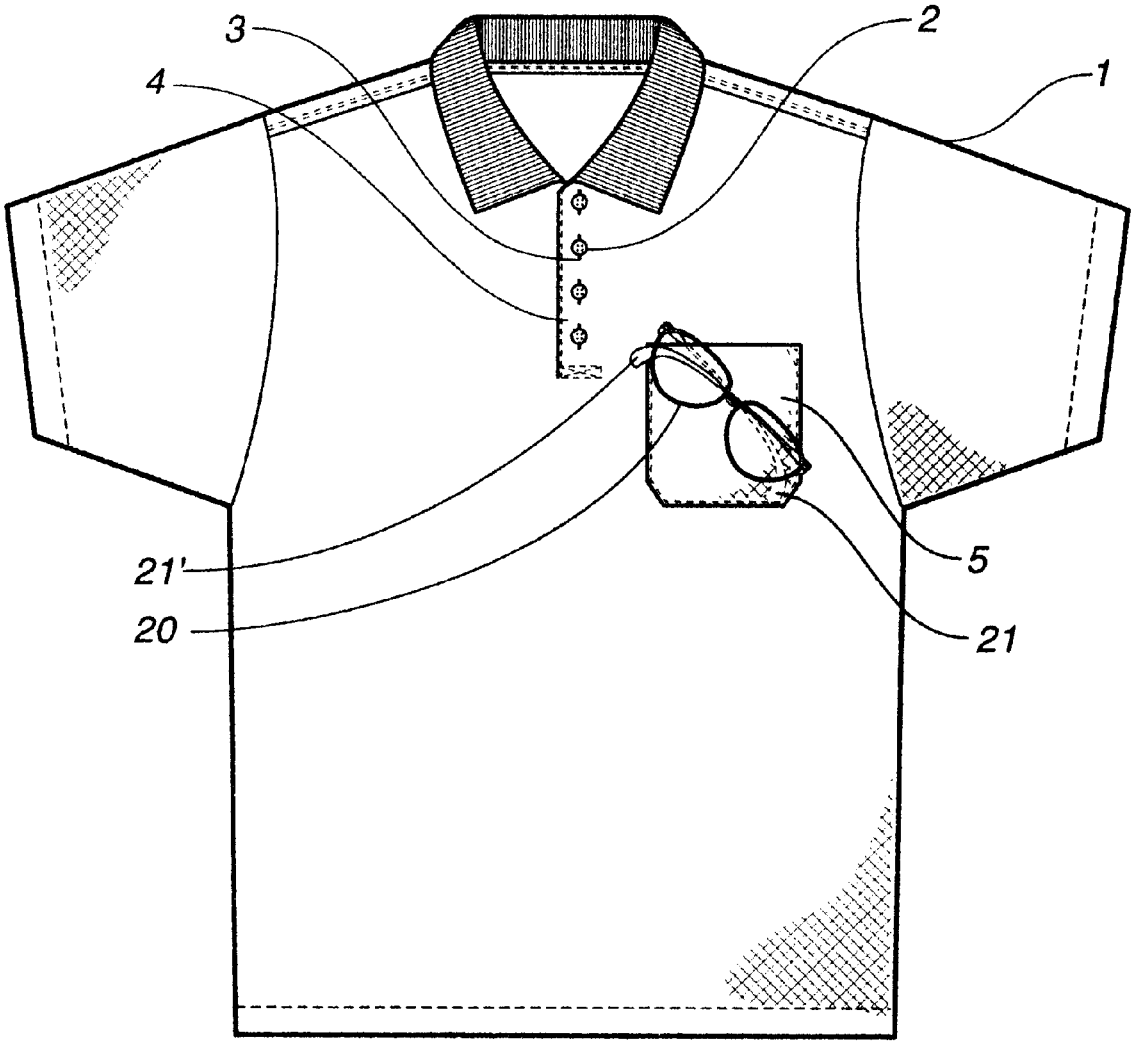
FIG. 9B Prior Art

FIGS. 8*a* and 8*b* are views of a shirt 1 provided with a spectacle hanging means in accordance with the eighth embodiment of this invention. In the eight embodiment, the spectacle hanging means 10 comprises a rectangular hanging piece 18 which is attached, at its four corners, to the breast of the shirt 1 by four fixing members 19 at a position opposite to the pocket 5, thus forming a vertical hole allowing an arm 21 of a pair of spectacles 20 to pass through.

The operational effect of the spectacle hanging device according to the invention will be described hereinbelow.

When it is necessary for a user wearing the shirt 1 according to the primary embodiment of FIGS. 1*a* to 1*c* to hang a pair of spectacles 20 on the shirt 1, the user inserts an arm 21 of the spectacles 20 into the vertical slit 11 from the outside to the inside and fully exits the arm 21 out of the horizontal slit 11' as shown in FIG. 1*b*, thus threading the spectacles 20 through the slits 11 and 11' as shown in FIG. 1*c*. The spectacles 20, threaded through to the slits 11 and 11', allows the user to maintain an appealing appearance and show the user's fashion personality. In addition, the arm 21 is almost completely free from being unexpectedly removed from the slits 11 and 11', thus allowing the user to safely keep the spectacles 20 on the shirt 1 when removing the spectacles from the user's face.

In order to hang a pair of spectacles 20 on the shirt 1 according to the second embodiment of FIGS. 2*a* to 2*c*, a user wearing the shirt 1 inserts an arm 21 of the spectacles 20 into the fob 12 from the top to the bottom with both arms 21 and 21' of the spectacles 20 being fully folded as shown in FIGS. 2*b* and 2*c*. In the above case, it is preferable to exit the end of the arm 21 out of the horizontal slit 13 of the fob 12. When the spectacles 20 are hung on the shirt 1 with the end of the arm 21 exiting out of the horizontal slit 13 as described above, the arm 21 is more stably held by the fob 12, so the spectacles 20 are almost free from being unexpectedly removed from the shirt 1.

Meanwhile, in the case of the shirt 1 according to the third embodiment of FIGS. 3*a* to 3*c*, a user wearing the shirt 1 inserts an arm 21 of a pair of spectacles 20 into either loop 14, 14' with both arms 21 and 21' of the spectacles 20 being fully folded as shown in FIGS. 3*b* and 3*c*. When the arm 21 is inserted into or removed from either loop 14, 14', the loop 14, 14' allows the arm 21 to easily pass through since the loop 14, 14' is made of an elastic material capable of being easily extended. However, when the arm 21 is completely inserted into a loop 14, 14', the loop 14, 14' elastically tightens around the arm 21, thus safely keeping the spectacles 20 on the shirt 1.

When it is necessary for a user wearing the shirt 1 according to the fourth embodiment of FIGS. 4*a* to 4*c* to hang a pair of spectacles 20 on the shirt 1, the user inserts an arm 21 of the spectacles 20 into either of the band or loop 15 and 15' with both arms 21 and 21' of the spectacles 20 being fully folded as shown in FIGS. 4*b* and 4*c*.

Meanwhile, in the case of the shirt 1 according to the fifth embodiment of FIGS. 5*a* to 5*c*, a user wearing the shirt 1 inserts an arm 21 of a pair of spectacles 20 into the band 16 with both arms 21 and 21' of the spectacles 20 being fully folded as shown in FIGS. 5*b* and 5*c*.

Figure 7:
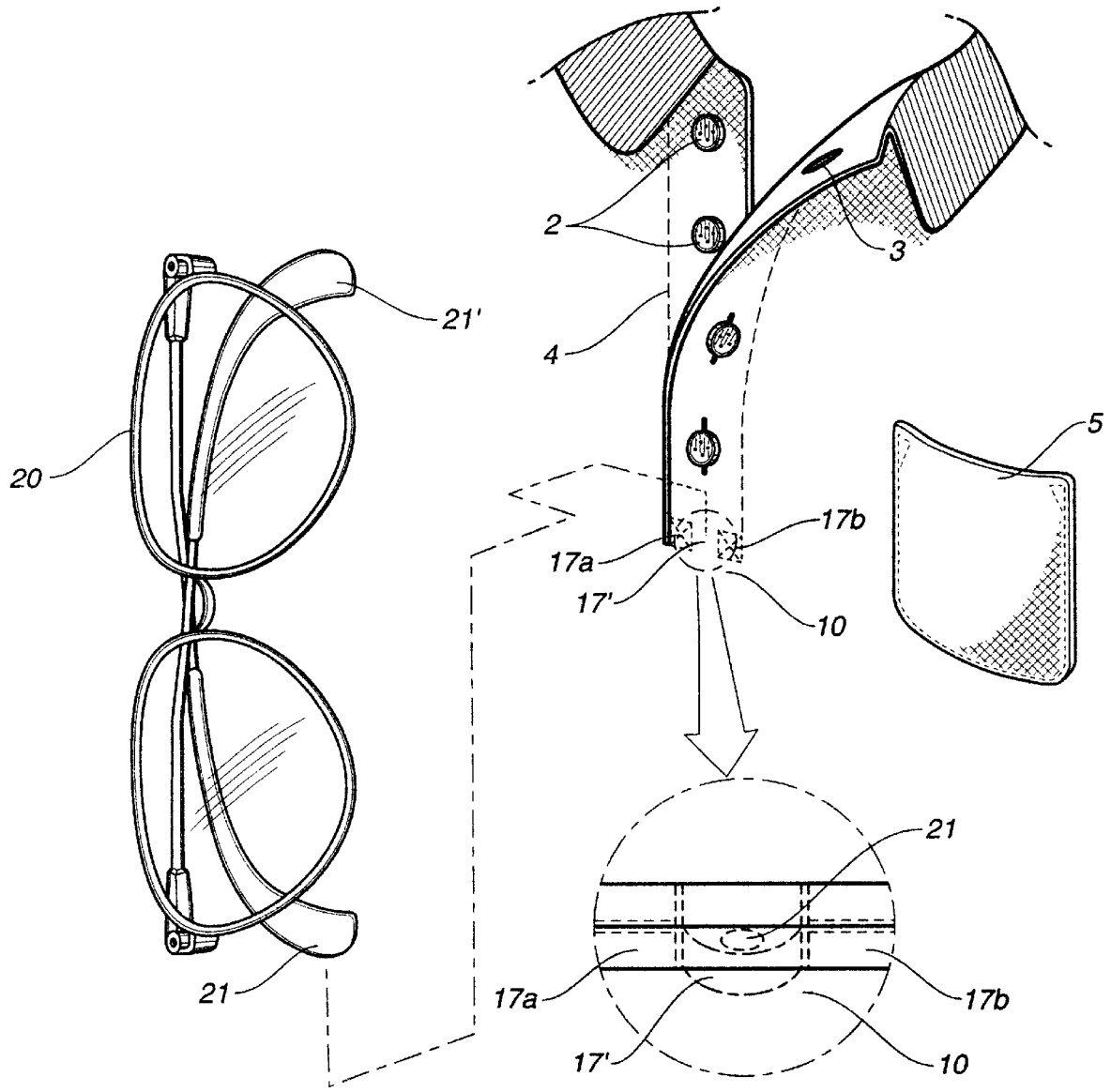
FIG. 7 is view of a shirt interiorly provided with a spectacle hanging hole at the stitched lower junction of the button-down front opening at the center position in accordance with the seventh embodiment of the present invention.

In order to hang a pair of spectacles 20 on the shirt 1 according to one of the sixth and seventh embodiments of FIGS. 6*a* to 7, a user wearing the shirt 1 inserts an arm 21 of the spectacles 20 into the hanging hole 17, 17' from the top to the bottom with both arms 21 and 21' of the spectacles 20 being fully folded as shown in FIGS. 6*b* and 7.

In such a case, the arm 21, which is inserted into the hole 17, 17', is positioned inside the shirt 1, so the arm 21 is not exposed to the outside of the shirt 1 with the remaining part of the spectacles 20 being exposed to the outside of the shirt 1.

When the arm 21 is inserted into the hole 17, 17' as described above, the spectacles 20 are stably hung on the shirt 1. The spectacles 20 are thus almost completely free from being unexpectedly removed from the shirt 1 even when the user bends forward the user's upper body or comes into unexpected contact with another person at the upper part of the body.

Particularly, the vertical hole 17' according to the seventh embodiment is provided with the two decoratively stitched parts 17*a* and 17*b* at both sides, so the hole 17' safely holds the spectacles 20 on the shirt 1 and improves the appealing appearance of the shirt 1.

When it is necessary for a user wearing the shirt 1 according to the eighth embodiment of FIGS. 8*a* and 8*b* to hang a pair of spectacles 20 on the shirt 1, the user inserts an arm 21 of the spectacles 20 into the hanging piece 18 from the top to the bottom with both arms 21 and 21' of the spectacles 20 being fully folded as shown in FIG. 8*b*. In such a case, the end of the arm 21 is exposed to the bottom of the hanging piece 18, so the arm 21 is stably held by the hanging piece 18. The spectacles 20 are thus safely and stably kept on the shirt 1.

As described above, the present invention provides a device for hanging a pair of spectacles on a garment. The hanging device comprises a specifically designed hanging means, which is provided on the garment and is used for allowing a user to easily, conveniently and safely hang spectacles on the garment when taking off the spectacles. The hanging device thus allows a user to easily and safely keep the spectacles on the garment when taking off the spectacles. The spectacles, hung on a garment by the hanging device of this invention, are almost completely prevented from unexpectedly breaking or being lost and allows a user to maintain an appealing appearance and show the user's fashion personality.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for hanging spectacles on a garment, comprising:

spectacle hanging means formed at one or more of a neck, breast, pocket, and buttondown opening of the garment and adapted for selectively holding an arm of the spectacles so as to hang the spectacles on the garment, wherein said spectacle hanging means comprises:

a vertical slit formed at a lower portion of a buttonholed part of said opening and allowing an arm of the spectacles to be inserted into the buttonholed part: and a horizontal slit formed on the buttonholed part at a position vertically and downwardly spaced apart from the vertical slit by a distance and allowing the arm to stick out of the buttonholed part.

2. A device for hanging spectacles on a garment, comprising:

spectacle hanging means formed at one or more of a neck, breast, pocket, and button-down opening of the garment and adapted for selectively holding an arm of the spectacles so as to hang the spectacles on the garment, wherein said spectacle hanging means comprises:

a narrow spectacle-arm fob formed by sewing said pocket to the body of the garment along a vertical line spaced apart from an inside edge of the pocket by a predetermined width, said spectacle-arm fob having a horizontal slit at a middle portion so an arm of the spectacles may be inserted into the fob at a top edge of the fob and stick out of the fob through said horizontal slit.

3. A device for hanging spectacles on a garment, comprising:

spectacle hanging means formed at one or more of a neck, breast, pocket, and button-down opening of the garment and adapted for selectively holding an arm of the spectacles so as to hang the spectacles on the garment, wherein said spectacle hanging means comprises:

a vertical hole interiorly formed on a stitched lower junction of buttoned and buttonholed parts of said opening by partially sewing lower ends of the buttoned and buttonholed parts together in a way such that said vertical hole remains on the stitched lower junction of the opening at a position slanted to a side.

4. A device for hanging spectacles on a garment, comprising:

spectacle hanging means formed at one or more of a neck, breast, pocket, and button-down opening of the garment and adapted for selectively holding an arm of the spectacles so as to hang the spectacles on the garment, wherein said spectacle hanging means comprises:

a vertical hole interiorly formed on a stitched lower junction of buttoned and buttonholed parts of said opening by partially sewing lower ends of the buttoned and buttonholed parts together in a way such that said vertical hole remains on a central portion of the stitched lower junction of the opening with two decoratively stitched parts being formed at both sides of the vertical hole.

* * * * *